US006749322B2

(12) United States Patent
Chen

(10) Patent No.: US 6,749,322 B2
(45) Date of Patent: Jun. 15, 2004

(54) WATERPROOF LIGHTING DEVICE

(76) Inventor: Chuen-Shing Chen, No. 13-15, Shen-Lin Road, Shen-Kang Shiang, Taichung Hsien (TW)

( * ) Notice: Subject to any disclaimer, the term of this patent is extended or adjusted under 35 U.S.C. 154(b) by 45 days.

(21) Appl. No.: 10/189,550

(22) Filed: Jul. 8, 2002

(65) Prior Publication Data

US 2004/0004834 A1 Jan. 8, 2004

(51) Int. Cl.[7] ..... F21V 23/02
(52) U.S. Cl. ..... 362/222; 362/223; 362/267
(58) Field of Search ..... 362/222, 267, 362/223, 221, 225, 158, 353, 310, 217, 224, 307

(56) References Cited

U.S. PATENT DOCUMENTS 5,716,123 A * 2/1998 Lamming ..... 362/222

* cited by examiner

*Primary Examiner*—Sandra O'Shea
*Assistant Examiner*—Bao Q. Truong
(74) *Attorney, Agent, or Firm*—Greenblum & Bernstein, P.L.C.

(57) ABSTRACT

A waterproof lighting device includes a tubular transparent casing, a lamp circuit, and first and second end caps mounted to opposite open ends of the casing so as to close the opposite open ends of the casing. The lamp circuit includes a lamp board mounted on a curved base plate, a receiving space defined between the lamp board and the base plate, a light emitting member mounted on the lamp board, a ballast disposed in the receiving space and connected electrically to the light emitting member, and a power cord having one end coupled electrically to the lamp board, and an opposite end extending through the first end cap and terminated by a power plug.

9 Claims, 4 Drawing Sheets

WATERPROOF LIGHTING DEVICE

BACKGROUND OF THE INVENTION

1. Field of the Invention

The invention relates to a lighting device, more particularly to a waterproof lighting device for processing equipment, such as lathes.

2. Description of the Related Art

A conventional waterproof lighting device for processing equipment has a ballast and a fluorescent lamp that are mounted on the same side of a lamp board and that are aligned with each other along a longitudinal direction of the lighting device. As such, the entire length of the conventional waterproof lighting device is relatively long, thereby making it not suitable for use in a comparatively crowded space.

SUMMARY OF THE INVENTION

Therefore, the main object of the present invention is to provide a waterproof lighting device that is capable of overcoming the aforementioned drawback of the prior art.

According to this invention, a waterproof lighting device includes a tubular transparent casing, a lamp circuit disposed in the casing, and first and second end caps mounted fittingly, sealingly and respectively to opposite ends of the casing so as to close the opposite ends of the casing. The lamp circuit includes a curved base plate, a lamp board mounted on the base plate, a receiving space defined between a bottom surface of the lamp board and a top surface of the base plate, a light emitting member mounted on a top surface of the lamp board, a ballast, and a power cord. The ballast is disposed in the receiving space, and is connected electrically to the light emitting member. The power cord has one end coupled electrically to the ballast, and an opposite end extending through the first end cap and terminated by a power plug.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
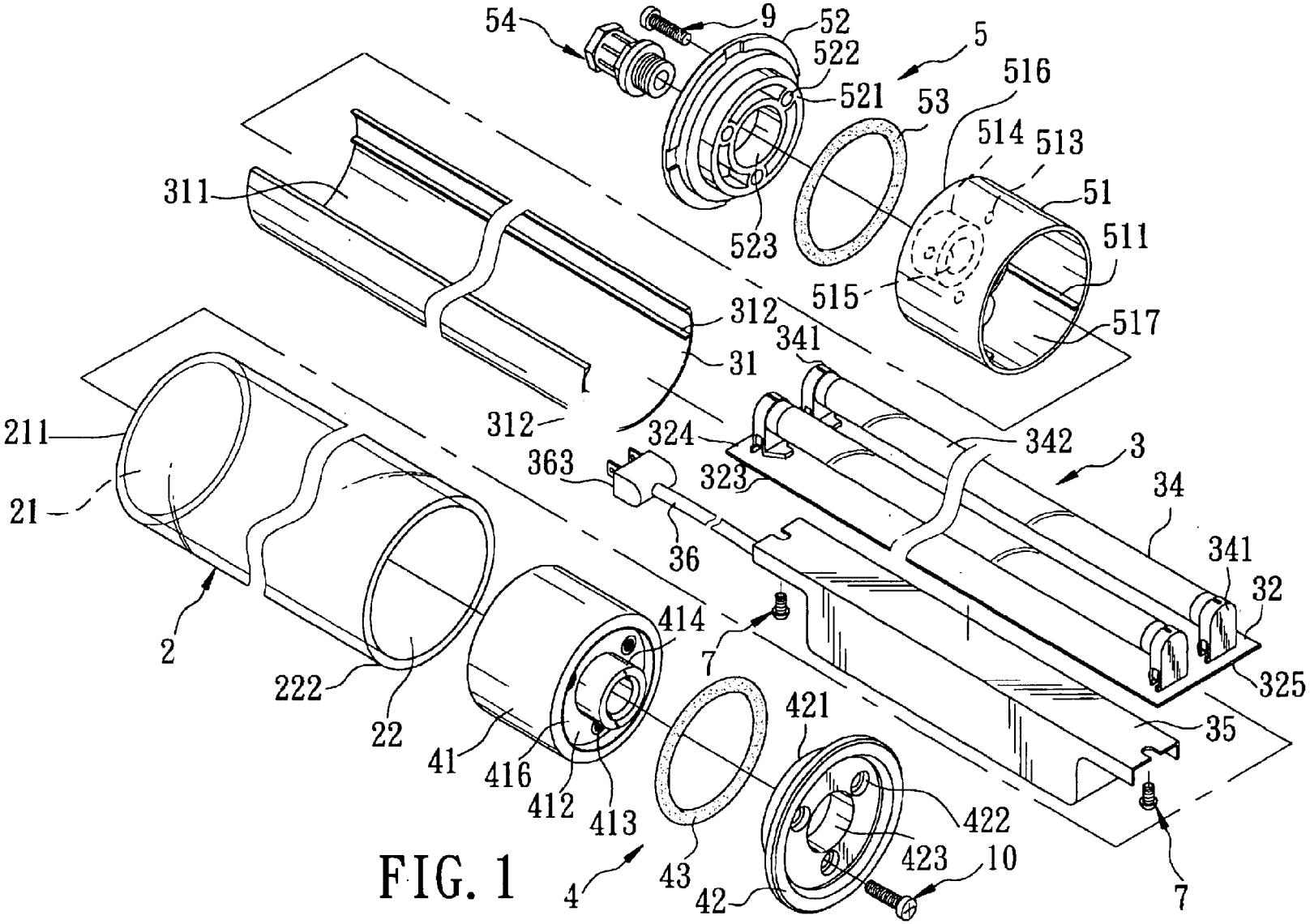
FIG. 1 is a partly exploded perspective view of the preferred embodiment of a waterproof lighting device according to the present invention.

Referring to FIGS. 1 to 4, the preferred embodiment of a waterproof lighting device according to the present invention is shown to include a tubular transparent casing 2, a lamp circuit 3, and first and second end caps 5, 4.

The tubular transparent casing 2 has two opposite open ends 21, 22 with first and second end faces 211, 222, respectively.

Figure 2:
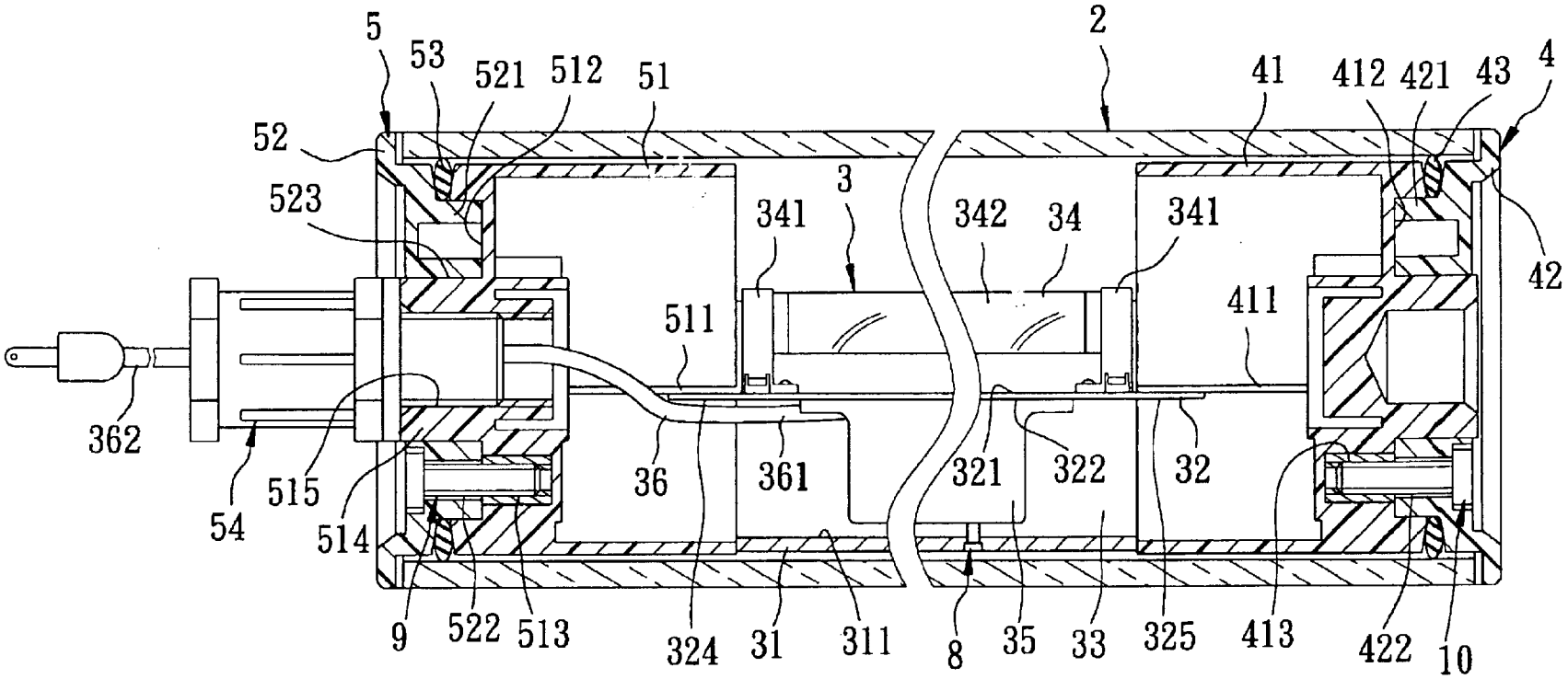
FIG. 2 is a sectional view of the preferred embodiment.
Figure 3:
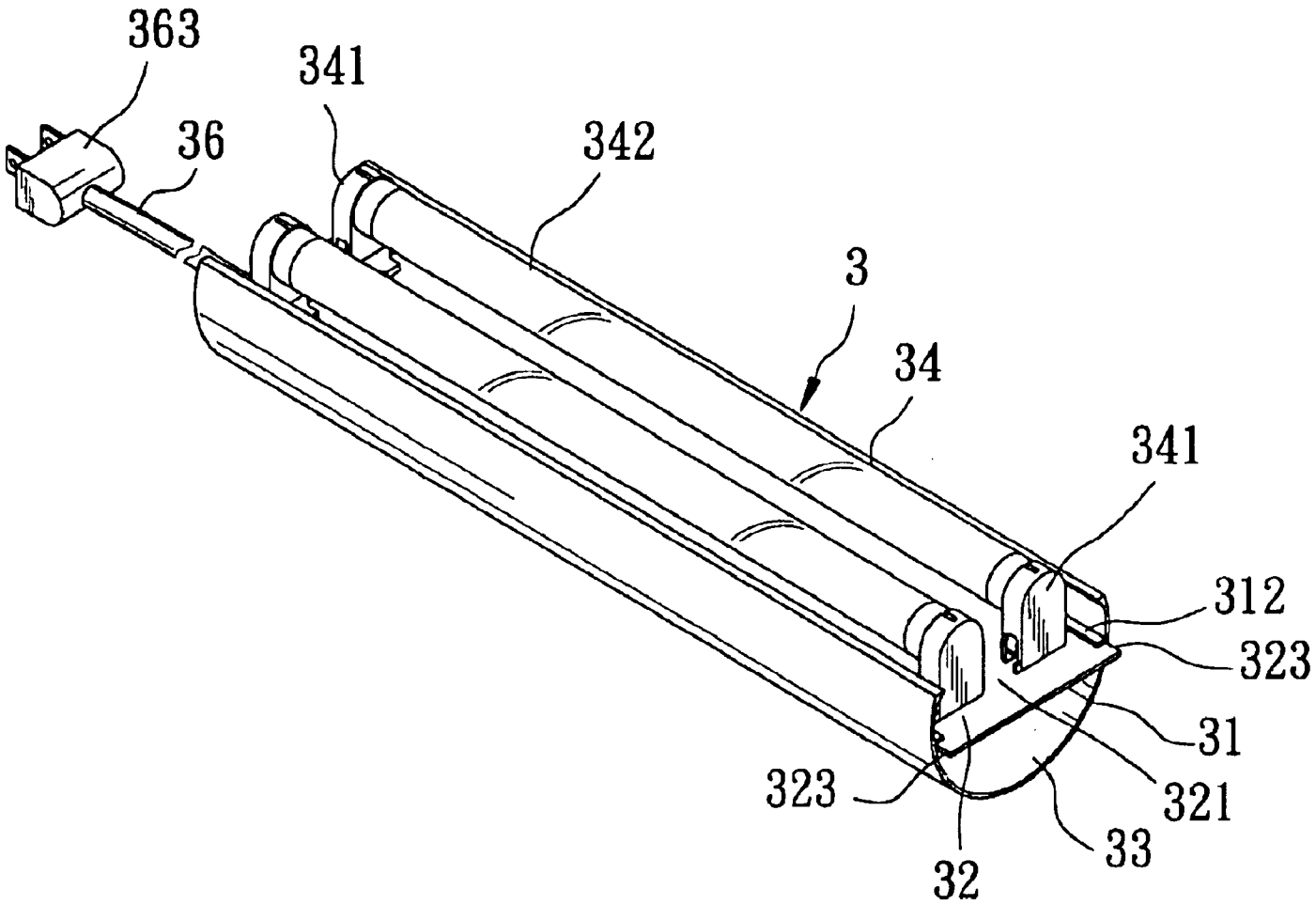
FIG. 3 is an assembled perspective view of a lamp circuit of the preferred embodiment.
Figure 4:
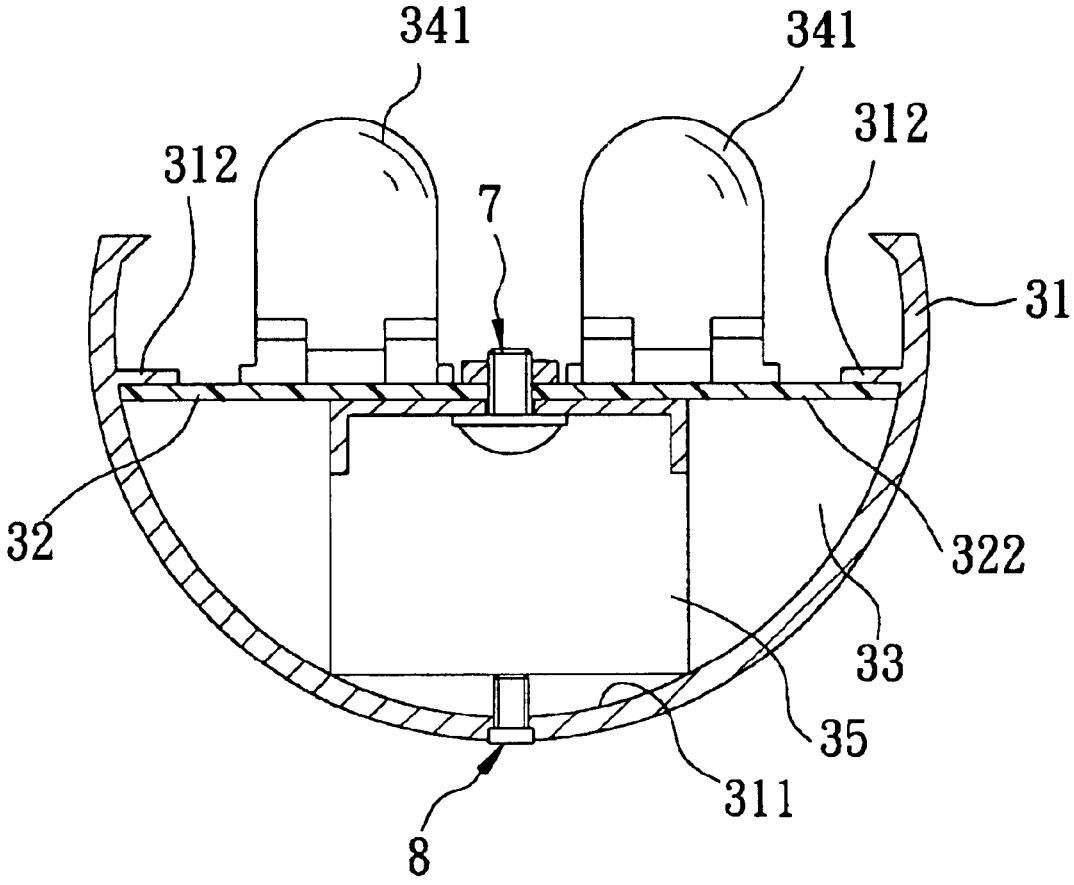
FIG. 4 is a sectional view of the lamp circuit of the preferred embodiment.

The lamp circuit 3 is disposed in the casing 2, and includes a curved base plate 31, a lamp board 32, a receiving space 33, a light emitting member 34, a ballast 35, and a power cord 36. The curved base plate 31 has a pair of inwardly extending integral horizontal stop ribs 312 that abut respectively against top sides of opposite longitudinal edges 323 of the lamp board 32 (see FIG. 3). The lamp board 32 is mounted on the base plate 31, and has opposite first and second lateral ends 324, 325 that project from opposite lateral ends of the base plate 31. The receiving space 33 is defined between a bottom surface 322 of the lamp board 32 and a top surface 311 of the base plate 31. In this embodiment, the light emitting member 34 includes two pairs of positioning seats 341 mounted on the top surface 321 of the lamp board 32 and connected electrically to the ballast 35, and a pair of fluorescent lamps 342, each of which is mounted between a respective pair of the positioning seats 341. The ballast 35, in this embodiment, is an electronic ballast. The ballast 35 is disposed in the receiving space 33 under the light emitting member 34, is connected electrically to the light emitting member 34, and is secured to the bottom surface 322 of the lamp board 32 by means of screws 7. Also, in this embodiment, the ballast 35 has a bottom surface pressed by a plurality of lock bolts 8 (only one is shown in FIGS. 2 and 4) so as to secure the ballast 35 firmly within the receiving space 33. The power cord 36 has one end 361 coupled electrically to the ballast 35, and an opposite end 362 extending through the first end cap 5 and terminated by a power plug 363. The power plug 363 connects the lamp circuit 3 to an electrical outlet (not shown) for activating the lamp circuit 3 in a conventional manner.

The first end cap 5 includes a first tubular cap body 51, a first lock seat 52, a tubular cord guide 54, and a first O-ring 53. The first tubular cap body 51 is formed with an open end portion 517 fitted in one of the open ends 21, 22 of the casing 2, a recessed end portion 516 opposite to the open end portion 517, and a pair of inwardly extending integral stop ribs 511 that abut against a top side of the first lateral end 324 of the lamp board 32. The recessed end portion 516 is formed with an end wall 512 having a protruding post 514 formed with a threaded cord hole 515, and three screw holes 513 around the cord hole 515. The first lock seat 52 abuts against the first distal end face 211 of the casing 2, and has a protruding portion 521 that corresponds to and that engages the recessed end portion 516 of the first cap body 51, and three through holes 522 and a central hole 523 that correspond respectively to the three screw holes 513 and the cord hole 515 in the recessed end portion 516. The first lock seat 52 is fastened to the end wall 512 of the first cap body 51 by means of three screw fasteners 9 (only one is shown in FIG. 1) that extend through the through holes 522 in the first lock seat 52, and that engage the screw holes 513 in the first cap body 51. The first O-ring 53 is disposed between the first cap body 51 and the first lock seat 52, and is in sealing engagement with the casing 2. The tubular cord guide 54 extends through the central hole 523 in the first lock seat 52, and engages threadedly the cord hole 515 in the end wall 512 of the first cap body 51. The opposite end 362 of the power cord 36 extends out of the casing 2 via the cord hole 515 and the cord guide 54.

The second end cap 4 includes a second tubular cap body 41, a second lock seat 42, and a second O-ring 43. The second tubular cap body 41 is formed with an open end portion 417 fitted in the other one of the open ends 21, 22 of the casing 2, a recessed end portion 416 opposite to the open end portion 417, and a pair of inwardly extending integral stop ribs 411. The recessed end portion 416 is formed with an end wall 412 having a protruding post 414, and three screw holes 413 around the post 414. The stop ribs 411 abut against a top side of the second lateral end 325 of the lamp board 32. The second lock seat 42 abuts against the second distal end face 222 of the casing 2, and has a protruding section 421, three through holes 422, and a central hole 423 for receiving the post 414. The protruding portion 421 corresponds to and engages the recessed end portion 416 of the second cap body 41. The three through holes 422 in the second lock seat 42 correspond to the three screw holes 413 in the second cap body 41. The second lock seat 42 is fastened to the end wall 412 of the second cap body 41 by means of three screw fasteners 10 (only one is shown in FIG. 1) that extend through the through holes 422 in the second lock seat 42, and that engage the screw holes 413 in the second cap body 41. The second O-ring 43 is disposed between the second cap body 41 and the second lock seat 42, and is in sealing engagement with the casing 2.

The first and second end caps 5, 4 are mounted fittingly, sealingly and respectively to opposite open ends 21, 22 of the casing 2 so as to close the opposite open ends 21, 22 of the casing 2, thereby providing a waterproof effect to the lamp circuit 3, as best illustrated in FIG. 2.

Some of the advantages of the waterproof lighting device of the present invention are as follows:

1. Since the ballast 35 and the fluorescent lamps 342 are disposed on opposite sides of the lamp board 32 of the lamp circuit 3, the entire length of the waterproof lighting device of the present invention can be shortened, thereby making it suitable for use in a comparatively crowded space.

2. Since the length of the waterproof lighting device of the present invention can be shortened, the manufacturing costs can be reduced because the lengths of the lamp board 32 and the tubular transparent casing 2 are shortened, and the volume of the packaging material can be smaller.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A waterproof lighting device including a tubular transparent casing, a lamp circuit disposed in said casing, and first and second end caps mounted fittingly, sealingly and respectively to opposite ends of said casing so as to close said opposite ends of said casing, wherein said lamp circuit includes a curved base plate, a lamp board mounted on said base plate, a receiving space defined between a bottom surface of said lamp board and a top surface of said base plate, a light emitting member mounted on a top surface of said lamp board, a ballast disposed in said receiving space and connected electrically to said light emitting member, and a power cord having one end coupled electrically to said ballast and an opposite end extending through said first end cap and terminated by a power plug, said curved base plate having a pair of inwardly extending integral horizontal stop ribs that abut respectively against top sides of opposite longitudinal edges of said lamp board.

2. The waterproof lighting device as claimed in claim 1, wherein said ballast comprises an electronic ballast.

3. The waterproof lighting of claim 1, wherein said light emitting member includes at least one pair of positioning seats mounted on the top surface of said lamp board and connected electrically to said ballast, and at least one florescent lamp mounted between said pair of positioning seats.

4. A waterproof lighting device, wherein including a tubular transparent casing, a lamp circuit disposed in said casing, and first and second end caps mounted fittingly, sealingly and respectively to opposite ends of said casing so as to close said opposite ends of said casing, wherein said lamp circuit includes a curved base plate, a lamp board mounted on said base plate, a receiving space defined between a bottom surface of said lamp board and a top surface of said base plate, a light emitting member mounted on a top surface of said lamp board, a ballast disposed in said receiving space and connected electrically to said light emitting member, and a power cord having one end coupled electrically to said ballast and an opposite end extending through said first end cap and terminated by a power plug, first end cap including:

a tubular cap body fitted in said casing and having a recessed end portion formed with an end wall, said end wall being formed with a cord hole;

a lock seat abutting against a distal end face of said casing and engaging said recessed end portion of said cap body;

a tubular cord guide extending through said lock seat and engaging threadedly said cord hold in said end wall, said opposite end of said power cord extending out of said casing via said cord hole and said cord guide; and an O-ring disposed between said cap body and said lock seat and in sealing engagement with said casing.

5. The waterproof lighting device of claim 4, further comprising screw fasteners that fasten said lock seat to said end wall of said cap body.

6. The waterproof lighting device of claim 4, wherein said lamp board has a lateral end that extends into said cap body, said cap body being formed with a pair of inwardly extending integral stop ribs that abut against a top side of said lateral end of said lamp board.

7. A waterproof lighting device including a tubular transparent casing, a lamp circuit disposed in said casing, and first and second end caps mounted fittingly, sealingly and respectively to opposite ends of said casing so as to close said opposite ends of said casing, wherein said lamp circuit includes a curved base plate, a lamp board mounted on said base plate, a receiving space defined between a bottom surface of said lamp board and a top surface of said base plate, a light emitting member mounted on a top surface of said lamp board, a ballast disposed in said receiving space and connected electrically to said light emitting member, and a power cord having one end coupled electrically to said ballast and an opposite end extending through said first end cap and terminated by a power plug, said second end cap including:

a tubular cap body fitted in said casing and having a recessed end portion formed with an end wall;

a lock seat abutting against a distal end face of said casing and engaging said recessed end portion of said cap body; and an O-ring disposed between said cap body and said lock seat and in sealing engagement with said casing.

8. The waterproof lighting device of claim 7, further comprising screw fasteners that fastens said lock seat to said end wall of said cap body.

9. The waterproof lighting device of claim 7, wherein said lamp board has a lateral end that extends into said cap body, said cap body being formed with a pair of inwardly extending integral stop ribs that abut against a top side of said lateral end of said lamp board.

* * * * *